United States Patent [19]

Barrineau

[11] 4,292,902

[45] Oct. 6, 1981

[54] SHELF SYSTEM

[76] Inventor: Wade H. Barrineau, 5159 E. Shore Dr., Conyers, Ga. 30207

[21] Appl. No.: 737,401

[22] Filed: Nov. 1, 1976

Related U.S. Application Data

[63] Continuation of Ser. No. 628,133, Nov. 3, 1975, abandoned.

[51] Int. Cl.[3] ..... A47B 57/16

[52] U.S. Cl. ..... 108/146; 108/110; 211/153; 211/187

[58] Field of Search ..... 211/126, 128, 134, 135, 211/153, 186, 187, 181; 108/106–110, 144, 146, 148, 96; 248/235, 239, 240, 241, 243, 247, 201, 207, 218.4, 219.1, 220.2, 221.3, 221.4, 222.1, 224.4, 225.2, 226.5

[56] References Cited

U.S. PATENT DOCUMENTS

| | | | |
|---|---|---|---|
| 677,624 | 7/1901 | Beckwith | 108/111 |
| 714,220 | 11/1902 | Mohr | 108/110 |
| 721,404 | 2/1903 | Wege | 108/144 |
| 776,233 | 11/1904 | Green et al. | 108/110 |
| 777,256 | 12/1904 | Holden | 211/153 |
| 2,684,884 | 7/1954 | Devery | 312/351 |
| 2,761,568 | 9/1956 | Temple | 108/59 |
| 2,919,817 | 1/1960 | Maslow | 108/111 |
| 2,933,195 | 4/1960 | Radek | 211/153 |
| 2,970,702 | 2/1961 | Maslow | 108/106 |
| 2,992,742 | 7/1961 | Pendergrast | 108/146 |
| 3,138,123 | 6/1964 | Maslow | 108/159 |
| 3,154,028 | 10/1964 | Hamilton | 108/111 X |
| 3,168,365 | 2/1965 | Evans | 211/153 X |
| 3,294,250 | 12/1966 | Evans | 211/190 |
| 3,330,229 | 7/1967 | Ferdinand et al. | 211/187 X |
| 3,343,506 | 9/1967 | Buchbinder et al. | 108/107 |
| 3,669,520 | 6/1972 | Jansen | 312/351 |
| 3,680,938 | 8/1972 | Ohlsson | 211/187 X |
| 3,705,654 | 12/1972 | Barrineau | 108/110 |

FOREIGN PATENT DOCUMENTS

| | | | |
|---|---|---|---|
| 446299 | 1/1948 | Canada | 108/107 |
| 601755 | 7/1960 | Canada | 108/108 |
| 193540 | 12/1964 | Sweden | 211/187 |

*Primary Examiner*—Roy D. Frazier
*Attorney, Agent, or Firm*—Arnold, White & Durkee

[57] ABSTRACT

A shelf system especially suited for installation in closed spaces such as van trucks. Four vertically, spaced front and rear posts are installed vertically as opposite corners of the shelf structure and each post comprises an open channel having vertically spaced openings therein. The channels in the front and rear posts are arranged to face towards each other. A plurality of shelves each comprises a flat steel band member on the elongated front and rear edges with each band member having an arcuate end leading to a notched tip or hook which fits in a respective opening in the vertical member. The ends of the band on one side are freely flexible for insertion of the hooks in the openings.

10 Claims, 4 Drawing Figures

SHELF SYSTEM

This is a continuation of application Ser. No. 628,133, filed Nov. 3, 1975, now abandoned.

BACKGROUND OF THE INVENTION

1. Field of the Invention

Adjustable shelves.

2. Description of the Prior Art

Prior art includes a number of adjustable shelves which can be installed in closed or restricted spaces such as van trucks. However, there are some difficulties involved in trying to remove and replace shelves. The present invention provides a simple arrangement not only from the standpoint of manufacturing and installation but also from the standpoint of simple dependable removal and replacement of shelves.

SUMMARY OF THE INVENTION

A system of multiple shelves which may be installed in restricted spaces such as van trucks and other places where it may not be feasible or convenient to reach to that side of the shelf which is normally closed by the outside of the vehicle or other closure.

A primary advantage of the present shelf arrangement is the simplicity in manufacture and use.

An object of this invention is to provide a shelving system having few movable parts but being capable of insertion and removal with little chance of accidental displacement during use.

Another object of the present invention is found in the present shelf arrangment which lends itself to manufacture by welding plated wire and the use of simple channels as vertical supports.

Another object of the present invention is found in the positive locking arrangement which is simple to manipulate and operate but yet is practically foolproof against accidental displacement after installation.

Other and further objects and advantages of the present invention will become apparent upon reading the following description taken in conjunction with the accompanying drawings.

BRIEF DESCRIPTION OF A PREFERRED EMBODIMENT

Figure 1:
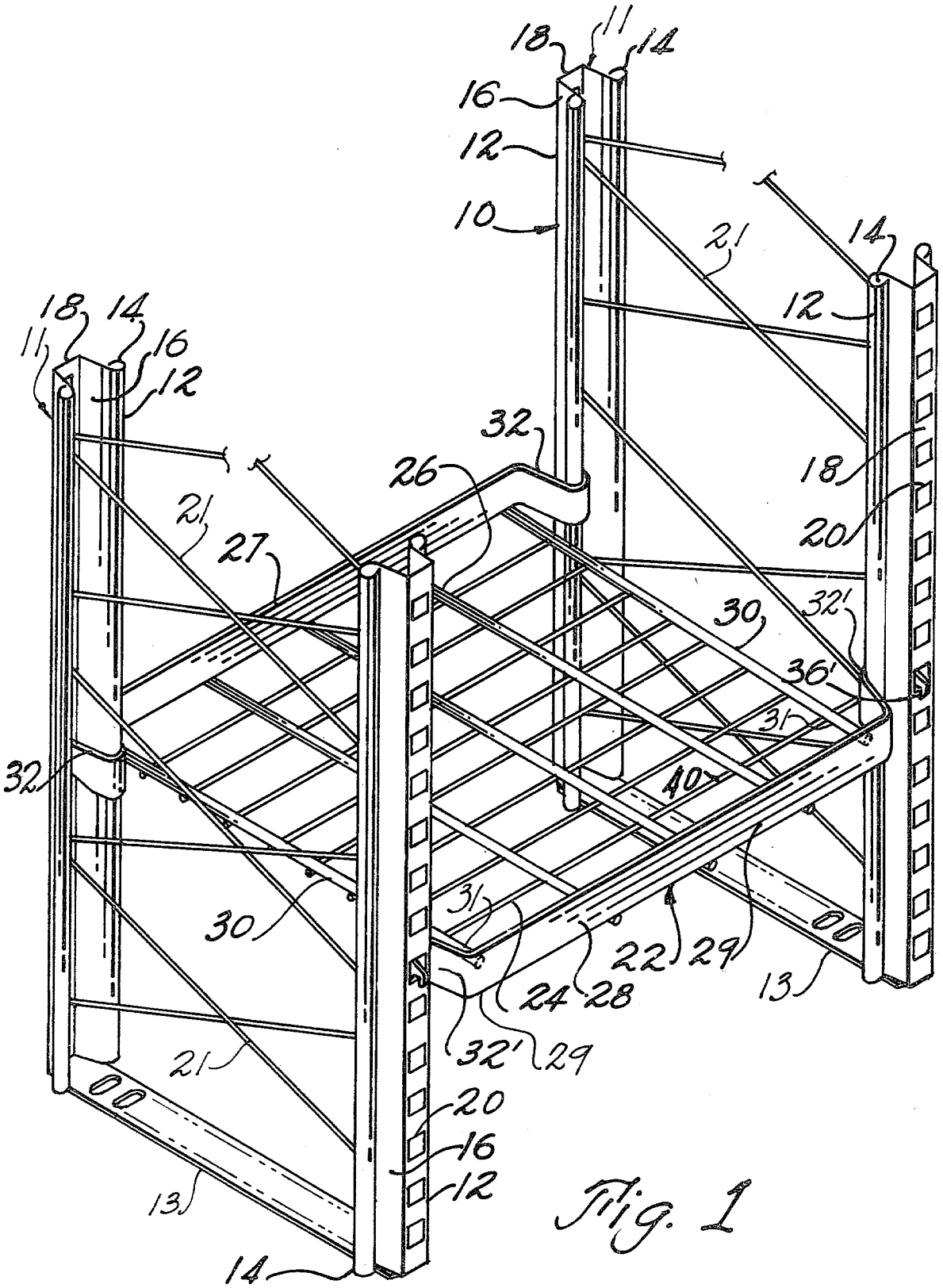
FIG. 1 is a perspective view of one shelf and supporting posts with portions broken away.
Figure 3:
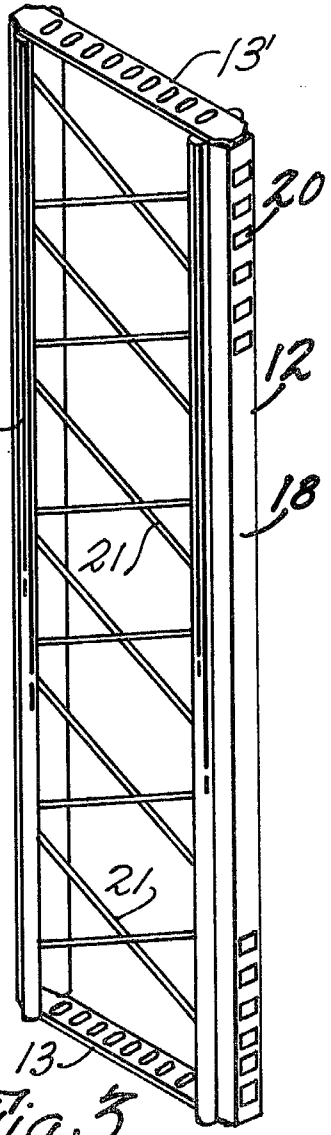
FIG. 3 is a perspective view of one vertical side.

The present shelf structure lends itself to the installation of multiple shelves one above the other in a closed or restricted space such as a van truck or closet or the like and while only one shelf is illustrated it is to be understood that in actual installation and use there would probably be many other shelves both above and below the one actually shown.

The shelf structure as a whole is designated generally by reference numeral 10 comprises sides 11 each having 2 spaced corner post members 12 of identical construction attached by bottom and top members 13, 13'. Each post member 12 is formed from lightweight metal having a channel formation with rolled outer edges 14 on respective slanted sides 16 extending from a channel portion 18 in which there have been punched a plurality of spaced notches or openings 20 representing different positions of a shelf designated generally by reference numeral 22. Each side 11 comprises two post members 12 permanently connected by means of diagonal rod or wire members 21 welded in place.

Shelf 22 is of square or rectangular construction and in the present form is made from a plurality of welded steel wires, there being longitudinal wires 24 joined by transverse wires 26 at various spaced locations. Shelf 22 has identical flat steel band edges rear edge member 27 and front edge member 28 representing respectively the rear edge and the front edge of shelf 22 for purpose of orientation during the present discussion. It may be that the rear edge 27 would be installed against a confined wall (not shown) or side of the space in a van truck (not shown). The rear edge member 27 is welded and fixed to the transverse members 26 including the corners whereas the band of front edge member 28 is not welded at the corners and as can be readily seen by the dotted line in FIG. 2, has opposite ends 29 free to be flexed by hand to bend and move for a limited distance over one of the next adjacent longitudinal members which is designated by reference numeral 30 and which has projecting ends 31 on each end of the shelf 10 for a purpose to be described. Each end 32 of the rear edge member 27 and also ends 32' of the front edge members 28 are bent approximately 180 degrees into respective curved portions providing a cavity in which is fitted one of the rolled edges 14 of a post 12. The respective ends 32, 32' of the rear edge member 27 and front edge member 28 extend at an angle on the bottom to form respective slanted edges 34, 34' leading to respective hooks 36, 36' which are normally are projections hooked through one of the respective spaces 20 over the material between adjacent spaces 20. The ends 32 of front edge member 28 are not welded, as mentioned previously and there is a length of material along front edge member 28 which permits this portion to flex in a front to rear manner and which can be held in a flexed position by the operator as the shelf is moved into position thereby allowing the operator to select the level at which he desires to locate the ends of member 28 thereby determining the height of the front of the shelf 10.

The shelf 10 is inserted into the upright assembly between the rear posts 12 which previously have been installed in the opening in fixed position, as for example by attaching top and bottom members 13, 13' to a floor or top, so as to provide a space having dimension between posts 12 at the front and rear on each side 11 whereby the distance between tips of the hooks 36, 36' of members 27, 28 are wider than the space between the inside of the channel 18 of the respective upright members 12.

OPERATION

Figure 4:
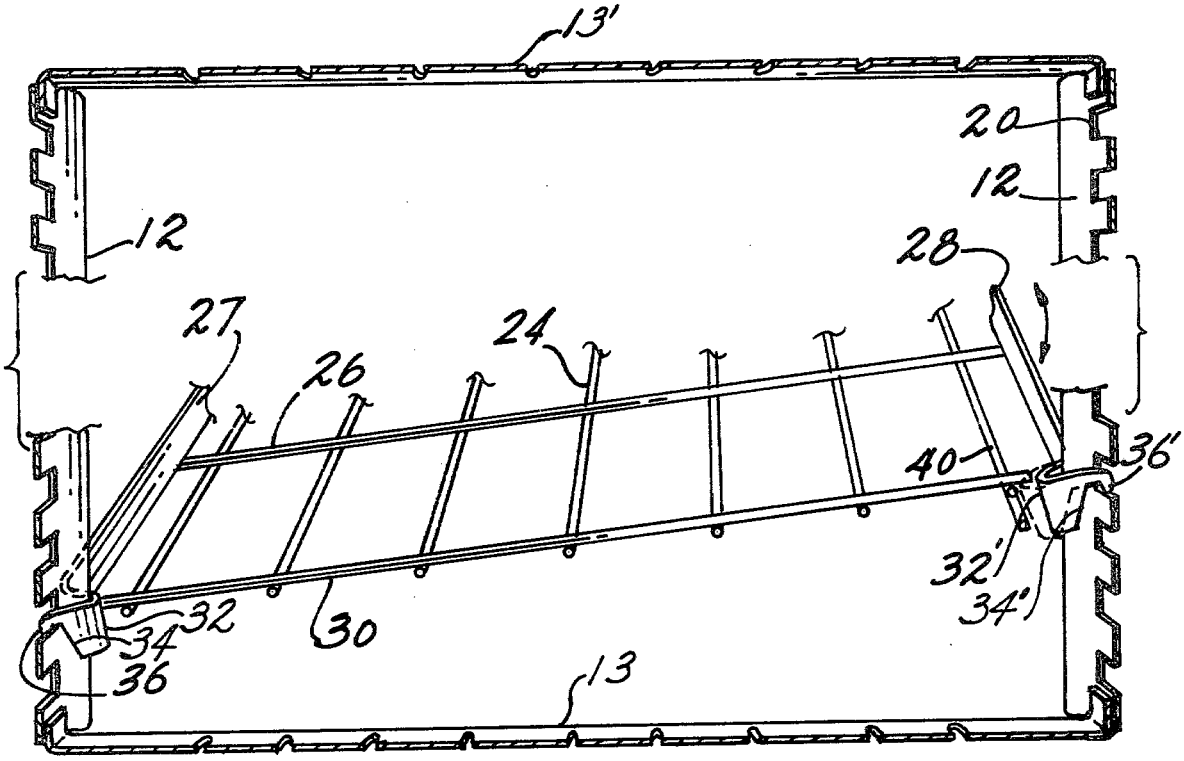
FIG. 4 is a perspective view of one side showing the end of a shelf installed on the vertical side members which are shown in vertical cross-section.

The shelf 10 is inserted into the upright assembly between the rear posts 12 and the respective hooks 36 of member 27 are first inserted into a selected slot 20 while the shelf 10 is being held in a tilted manner, front to rear in the manner shown in FIG. 4. After insertion of the hooks 36 of member 27 into the rear upright sections of posts 12 the shelf 10 is rotated to a horizontal or near horizontal plane front to rear and the tips of hooks 36' ride on the metal between holes 20 (FIG. 4). Because the tips of hooks 36, 36' of shelf parts 27, 28 usually are farther apart than the distance between the upright members 12, the tips of hooks 36, 36' protrude into the slots in post 12 and thereby affix the height of the shelf at the points where the tips of hooks 36,36' protrude through respective openings 20. It is necessary for the front member 28 to flex inward as the shelf is near horizontal position in the manner shown in FIG. 4 and the tip of the hooks 36' will slide along the face of the channel 18 between holes 20. The ends 32' of the front 28 can be held in flexed position by the operator as the shelf is rotated thereby allowing the operator to select the level at which he desires to locate the front member 28 and thereby determining the height and inclination of the front of the shelf 10 which is normally horizontal.

Once in position, the shelf wire 30 protrusion 31 prevents accidental dislodgement of the shelf by releasing the lock mechanism of the front part 28 of front to rear load. The shelf front and rear members 27, 28 are shaped in such a manner as to insure a snug fit when the shelf 10 structure is in position with the upright post 12 thereby making the shelf an upright system a completely free standing structure requiring no side-to-side supports.

Figure 2:
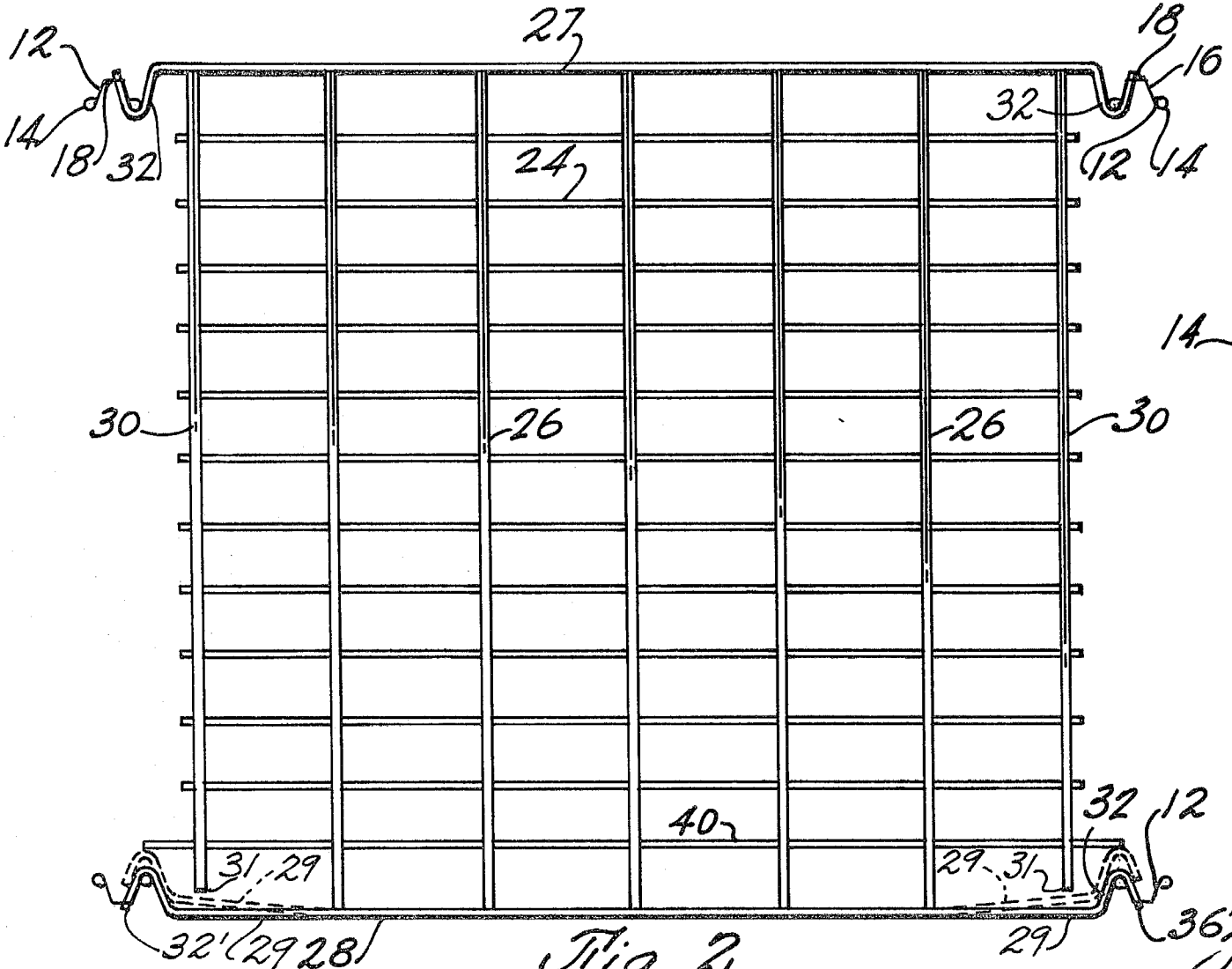
FIG. 2 is a top plan view of the shelf shown in FIG. 1 with parts omitted and dotted lines to indicate an adjustment.

The long, bottommost horizontal wire 40 shown in FIG. 2 functions to engage or bear against the rolled edge 14 of the upright member 12 thereby preventing accidental displacement or dislodgement of the rear shelf hooks 36 from the respective openings 20, which are slots, as would occur from a blow to the rear of the shelf which could cause deflection of the front movable shelf member 28. Also, the function of the shape 32 on the member 28 is to require a dual action or motion to release the lock, both upward and inward movement simultaneously to release the lock.

While I have shown and described a particular embodiment of this invention together with a suggested mode of operation this is by way of illustration only and does not constitute any sort of limitation on the invention since various alterations, changes, eliminations, deviations, omissions, additions, and departures may be made in the embodiment shown without departing from the scope of the invention as defined by the appended Claims.

What is claimed:

1. An adjustable and removable shelf assembly comprising:

a pair of rear vertical spaced supports having a plurality of vertically spaced openings therein;

a pair of opposed, spaced front vertical supports having a plurality of vertically spaced openings therein; and a removable shelf to be supported between the rear supports and the front supports, said shelf comprising;

a first rigid, non-flexing unitary edge member defining the outermost rear edge of the shelf and terminating in outwardly facing hooked projections for insertion into the openings of the rear vertical supports, a second unitary edge member defining the outermost front edge of the shelf and terminating in outwardly facing hooked projections, said second edge member being a flat strap with resiliently flexural ends permitting the hooked projections on opposing ends to be flexed inwardly for inserting said hooked projections into the openings of the front vertical supports while the hooked projections of the first edge member are engaged in the openings of the rear vertical support, shelf means formed of a rigid, non-flexing network of transverse and longitudinal supports, said transverse supports rigidly interconnecting substantially the full length of said first unitary edge member to a partial centrally located length of the second unitary edge member to provide a rigid, non-flexing support surface of the shelf and to define resiliently flexural ends on only the second edge member.

2. The assembly of claim 1 wherein each of said rear vertical supports and front vertical supports is an open channel post with the vertically spaced openings in the central portion of the open channel post.

3. The assembly of claim 2 wherein the open channels of the channel posts forming said rear vertical supports face inwardly toward the open channels of the channel posts forming said front vertical supports.

4. The assembly of claim 1 wherein said front and rear edge members have inwardly curved and outwardly returning end portions terminating with said outwardly facing hooked projections.

5. The assembly of claim 1 wherein:

the longitudinal supports are disposed substantially parallel to said first and second edge members; and the transverse intersecting supports are rigidly attached to said longitudinal supports, said transverse intersecting supports substantially perpendicular to said outermost edge members and interconnecting substantially the full length of the first unitary edge member with a partial centrally located length of the second of said unitary edge members.

6. In an adjustable and removable shelf assembly, rear vertical support means on said shelf assembly for removably supporting the rear of a shelf and having a plurality of vertically spaced openings therein, a removable shelf having a forward longitudinal member and a rearward longitudinal member spaced from and parallel to said forward member, insertion means on said rearward longitudinal member for insertion into respective openings in said rear vertical support means to position and support said shelf thereon, opposed, spaced front vertical support means for removably supporting the front of a shelf and each support means having a plurality of vertically spaced openings facing said rear vertical support means, said forward longitudinal member having at its ends terminal insertion portions projecting perpendicularly to the length of said longitudinal member and in a frontwise direction, and having end portions free to flex resiliently permitting the projections on opposing ends to be flexed inwardly for inserting said projections into the openings of the front vertical supports while the projections of said rearward member of said shelf are engaged in the openings of the rear vertical supports, shelf means formed of a rigid non-flexing network of transverse and longitudinal supports, said transverse supports rigidly interconnecting substantially the full length of the rearward longitudinal member to a partial centrally located length of said forward longitudinal member to provide a rigid non-flexing support surface of the shelf and to define resiliently flexural ends on only said forward longitudinal member, said terminal insertion portions being insertable into openings in said front vertical support means by first flexing said end portions rearwardly until said terminal insertion portions are aligned with the desired openings, then releasing said end portions to permit said terminal insertion portions to enter said openings by moving from rear to front.

7. In an adjustable and removable shelf assembly:

rear vertical, spaced support members on said shelf assembly for removably supporting the rear of a shelf and each having a plurality of vertically spaced openings therein, a removable shelf having a forward longitudinal member and a rearward longitudinal member spaced from and parallel to said forward member, terminal insertion portions on said rearward longitudinal member for insertion into respective openings in said rear vertical support means to position said shelf thereon, opposed, spaced front vertical support members for removably supporting the front of a shelf and having a plurality of vertically spaced openings therein, said forward longitudinal member having at its ends front terminal insertion portions projecting perpendicularly to the length of said longitudinal member, and having end portions free to flex resiliently permitting the projections on opposing ends to be flexed inwardly for inserting said projections into the openings of the front vertical supports while the projections of the rear of said shelf are engaged in the openings of the rear vertical supports, the distance between front and rear terminal insertion portions being greater than the fixed distance between the front and rear support means, whereby said end portions must be flexed from front to rear in order to install and remove said shelf, shelf means formed of a rigid non-flexing network of transverse and longitudinal supports, said transverse supports rigidly interconnecting substantially the full length of the rearward longitudinal member to a partial centrally located length of said forward longitudinal member to provide a rigid non-flexing support surface of the shelf and to define resiliently flexural ends on only said forward longitudinal member, said terminal insertion portions being insertable into openings in said front vertical support means by first flexing said free end portions rearwardly until said terminal insertion portions are aligned with the desired openings, then releasing said terminal insertion portions to enter said openings by moving from rear to front.

8. A shelf assembly as in claim 7 in which each of said forward and rearward longitudinal members are flat straps having a vertical width substantially greater than its thickness, each said strap supporting said terminal insertion portion against vertical flexing.

9. A shelf assembly as in claim 8 in which each said strap has an angulated end portion which surrounds a portion of the adjacent vertical support member.

10. An adjustable and removable shelf assembly comprising:

rear vertical, spaced posts for removably supporting the rear of a shelf and each having a plurality of vertically spaced openings therein, a removable shelf having a forward longitudinal member and a rearward longitudinal member spaced from and parallel to said forward member, terminal insertion portions on said rearward longitudinal member for insertion into respective openings in said rear posts to position said shelf thereon, opposed, spaced front vertical posts for removably supporting the front of a shelf and having a plurality of vertically spaced openings therein, said forward longitudinal member having at its ends front terminal insertion portions projecting perpendicularly to the length of said longitudinal member, and having end portions free to flex resiliently permitting the projections on opposing ends to be flexed inwardly for inserting said projections into the openings of the front vertical posts while the projections of said rearward member of said shelf are engaged in the openings of the rear vertical posts, the distance between front and rear terminal insertion portions being greater than the fixed distance between the front and rear posts, whereby said end portions must be flexed from front to rear in order to install and remove said shelf, said terminal insertion portions being insertable into openings in said front posts by first flexing said free end portions rearwardly until said terminal insertion portions are aligned with the desired openings, then releasing said terminal insertion portions to enter said openings by moving from rear to front, shelf means formed of a rigid non-flexing network of transverse and longitudinal supports, said transverse supports rigidly interconnecting substantially the full length of the rearward longitudinal member to a partial centrally located length of said forward longitudinal member to provide a rigid non-flexing support surface of the shelf and to define resiliently flexural ends on only said forward longitudinal member, said forward longitudinal member being a flat strap and said rearward longitudinal member being a flat strap, said straps having a vertical width substantially greater than its thickness, each strap supporting said terminal insertion portion against flexing in a direction perpendicular to the plane of said shelf while permitting flexure in the plane of said shelf, each said strap having an angulated end portion which surrounds a portion of said post.

* * * * *